US007551047B2

(12) United States Patent
Sokolow et al.

(10) Patent No.: US 7,551,047 B2
(45) Date of Patent: Jun. 23, 2009

(54) TAMPER RESISTANT GROUND FAULT CIRCUIT INTERRUPTER RECEPTACLE HAVING DUAL FUNCTION SHUTTERS

(75) Inventors: Stephen Sokolow, Locust Valley, NY (US); Edward Bazayev, Kew Gardens, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 117 days.

(21) Appl. No.: 11/674,061

(22) Filed: Feb. 12, 2007

(65) Prior Publication Data

US 2007/0211397 A1 Sep. 13, 2007

Related U.S. Application Data

(60) Provisional application No. 60/772,169, filed on Feb. 10, 2006.

(51) Int. Cl.

| | |
|---|---|
| ***H01H 9/00*** | (2006.01) |
| ***H01H 45/00*** | (2006.01) |
| ***H01H 83/00*** | (2006.01) |
| ***H01H 9/28*** | (2006.01) |
| ***H01R 13/70*** | (2006.01) |

(52) U.S. Cl. ..... 335/6; 200/43.01; 200/43.02; 200/43.11

(58) Field of Classification Search ..... 335/18; 200/43.01, 43.02, 43.11

See application file for complete search history.

(56) References Cited

U.S. PATENT DOCUMENTS

| | | | |
|---|---|---|---|
| 2,540,496 | A | 2/1951 | Sperrazza |
| 2,826,652 | A | 3/1958 | Piplack |
| 2,926,327 | A | 2/1960 | Metelli |
| 3,222,631 | A | 12/1965 | Cohen |

(Continued)

FOREIGN PATENT DOCUMENTS

| | | |
|---|---|---|
| GB | 2396489 | 6/2004 |

(Continued)

OTHER PUBLICATIONS

Appendix A To Meihao's Second Supp. Response to Interrogatory No. 6, *Leviton Mfg. Co., Inc.* vs. *Universal Security Instr.* (MD District Ct, Baltimore), 1:05-CV-00889-AMD.

(Continued)

*Primary Examiner*—Lincoln Donovan
*Assistant Examiner*—Alexander Talpalatskiy
(74) *Attorney, Agent, or Firm*—Carter, DeLuca, Farrell & Schmidt, LLP

(57) ABSTRACT

A receptacle including a front surface including one or more slots for receiving contact blades; a rear surface including one or more terminals for connecting the contact blades to a power source, the one or more terminals being line terminals and load terminals; a shutter positioned between the front surface and the rear surface of the receptacle, the shutter configured to be misaligned in relation to the one or more slots in order to obstruct a direct path between the contact blades and the one or more terminals, wherein insertion of an object in the one or more slots causes displacement of the shutter; and a shutter lock operatively connected in the receptacle to receive power from the power source connected to the receptacle.

20 Claims, 19 Drawing Sheets

U.S. PATENT DOCUMENTS 3,238,492 A 3/1966 Houston
3,617,662 A 11/1971 Miller
3,775,726 A 11/1973 Gress
3,986,763 A 10/1976 Sparrow
3,990,758 A 11/1976 Petterson
4,072,382 A 2/1978 Reschke
4,148,536 A 4/1979 Petropoulsos et al.
4,168,104 A 9/1979 Buschow
4,271,337 A 6/1981 Barkas
4,379,607 A 4/1983 Bowden, Jr.
4,544,219 A 10/1985 Barkas
4,603,932 A 8/1986 Heverly
4,714,858 A 12/1987 Sanders
4,722,693 A 2/1988 Rose
4,867,693 A * 9/1989 Gizienski et al. ..... 439/137
4,867,694 A * 9/1989 Short ..... 439/137
4,897,049 A 1/1990 Miller et al.
4,909,749 A 3/1990 Long
4,936,789 A 6/1990 Uglade
5,006,075 A 4/1991 Bowden, Jr.
5,020,997 A 6/1991 Calderara et al.
5,069,630 A 12/1991 Tseng et al.
5,277,607 A 1/1994 Thumma et al.
5,320,545 A 6/1994 Brothers
5,374,199 A 12/1994 Chung
5,391,085 A 2/1995 Tigner
5,518,132 A 5/1996 Chen
5,551,884 A 9/1996 Burkhart, Sr.
5,702,259 A 12/1997 Lee
5,839,909 A 11/1998 Calderara et al.
5,846,092 A 12/1998 Feldman et al.
5,902,140 A 5/1999 Cheung et al.
5,915,981 A 6/1999 Mehta
6,040,967 A 3/2000 DiSalvo
6,086,391 A 7/2000 Chiu
6,111,210 A 8/2000 Allison
6,149,446 A 11/2000 Yu
6,217,353 B1 4/2001 Yu-Tse
6,224,401 B1 5/2001 Yu
6,238,224 B1 5/2001 Shao
6,246,558 B1 6/2001 DiSalvo et al.
6,282,070 B1 8/2001 Ziegler et al.
6,288,882 B1 9/2001 DiSalvo et al.
6,299,487 B1 10/2001 Lopata et al.
6,381,112 B1 4/2002 DiSalvo
6,422,880 B1 7/2002 Chiu
6,437,700 B1 8/2002 Herzfeld et al.
6,437,953 B2 8/2002 DiSalvo et al.
6,537,088 B2 3/2003 Huang
6,537,089 B1 * 3/2003 Montague ..... 439/145
6,646,838 B2 11/2003 Ziegler et al.
6,657,834 B2 12/2003 DiSalvo
6,670,870 B2 12/2003 Macbeth
6,670,872 B2 12/2003 Kurzmann
6,671,145 B2 12/2003 Germain et al.
6,693,779 B2 2/2004 DiSalvo
6,717,782 B2 4/2004 DiSalvo et al.
6,734,769 B1 * 5/2004 Germain et al. ..... 335/6
6,749,449 B2 6/2004 Mortun
6,767,228 B2 7/2004 Katz
6,771,152 B2 8/2004 Germain et al.
6,776,630 B1 8/2004 Huang
6,786,745 B1 9/2004 Huang
6,788,173 B2 9/2004 Germain et al.
6,813,126 B2 11/2004 DiSalvo et al.
6,828,886 B2 12/2004 Germain et al.
6,864,766 B2 3/2005 DiSalvo et al.
6,873,231 B2 3/2005 Germain
6,893,275 B2 * 5/2005 Ng et al. ..... 439/137
6,930,574 B2 8/2005 Gao
6,937,451 B2 8/2005 Ulrich et al.
6,944,001 B2 9/2005 Ziegler et al.
6,949,994 B2 * 9/2005 Germain et al. ..... 335/18
6,958,895 B1 10/2005 Radosavljevic et al.
6,963,260 B2 * 11/2005 Germain et al. ..... 335/18
6,969,801 B2 * 11/2005 Radosavljevic et al. ..... 174/53
6,975,192 B2 12/2005 Disalvo
6,975,492 B2 12/2005 DiSalvo
6,979,212 B1 12/2005 Gorman
6,982,856 B2 1/2006 Bernstein
6,986,674 B1 1/2006 Gorman
7,026,895 B2 * 4/2006 Germain et al. ..... 335/18
7,031,125 B2 4/2006 Germain et al.
7,049,910 B2 5/2006 Campolo et al.
7,088,205 B2 8/2006 Germain et al.
7,088,206 B2 * 8/2006 Germain et al. ..... 335/18
7,098,761 B2 8/2006 Germain et al.
7,114,968 B2 10/2006 Healy
7,129,413 B1 10/2006 Rao et al.
7,177,126 B2 2/2007 Ulrich et al.
7,179,992 B1 2/2007 Packard et al.
7,209,330 B2 4/2007 DiSalvo
7,215,521 B2 5/2007 Bernstein
7,227,435 B2 6/2007 Germain
7,312,963 B1 * 12/2007 Radosavljevic et al. ..... 361/42
7,355,117 B2 4/2008 Castaldo et al.
2002/0097546 A1 7/2002 Weinberger
2002/0135960 A1 9/2002 Bernstein
2004/0184207 A1 9/2004 DiSalvo et al.
2004/0203270 A1 10/2004 Wang
2005/0002138 A1 1/2005 Germain et al.
2005/0024170 A1 * 2/2005 Germain et al. ..... 335/18
2005/0063110 A1 3/2005 DiSalvo et al.
2006/0007611 A1 1/2006 Ziegler et al.
2006/0132266 A1 6/2006 Disalvo
2006/0139132 A1 6/2006 Porter et al.
2006/0198071 A1 9/2006 Campolo et al.
2006/0273859 A1 12/2006 Germain et al.
2007/0049077 A1 3/2007 Germain
2007/0049079 A1 3/2007 Nalwad et al.
2007/0111569 A1 5/2007 Germain
2007/0114053 A1 5/2007 Castaldo
2007/0211397 A1 9/2007 Sokolow

FOREIGN PATENT DOCUMENTS

WO WO 00/17728 3/2000

OTHER PUBLICATIONS

PCT International Search Report, PCT/US08/53708 filed Feb. 12, 2008, mailed Sep. 16, 2008.

* cited by examiner

TAMPER RESISTANT GROUND FAULT CIRCUIT INTERRUPTER RECEPTACLE HAVING DUAL FUNCTION SHUTTERS

This application claims priority pursuant to 35 U.S.C. 119 (e) from U.S. Provisional Application having Application No. 60/772,169 filed Feb. 10, 2006.

TECHNICAL FIELD

The present disclosure generally relates to tamper-resistant shutters. In particular, the present disclosure relates to a shutter lock that is operatively connected in the receptacle to receive power from the power source connected to the receptacle.

BACKGROUND OF THE RELATED ART

In an effort to prevent electrical shock, circuit interrupting devices are designed to interrupt power to various loads, such as household appliances and consumer electrical products. In particular, electrical building codes in many states require that electrical circuits in residential or commercial bathrooms and kitchens be equipped with circuit interrupting devices. Household appliances are typically connected to electrical receptacles having at least a hot terminal and neutral terminal; the terminals are usually implemented as receptacles to which an electrical plug of the household appliance is attached. When an appliance is working properly, the current used by the appliance flows from the hot terminal of the electrical receptacle through the appliance and back to the neutral terminal of the receptacle. When, however, a person uses an appliance in the rain or near a wet surface, an extra path may be created from the appliance through the person and the water to ground. Consequently the amplitude of the current flowing from the receptacle to the household appliance is not be equal to the amplitude of the current flowing from the appliance back to the neutral terminal of the receptacle; that is, part of the current has been diverted through the extra path. Therefore, an imbalance in the current flow is created; this imbalance is typically referred to as a ground fault.

There exists a circuit between the receptacle and a power source which provides power to the receptacle. In particular, a hot or phase wire from the power source is connected to a phase terminal of the receptacle and a neutral wire from the power source is connected to a neutral terminal of the receptacle. A circuit interrupting device, such as a ground fault circuit interrupter (GFCI) is placed in the receptacle and is connected to the phase and neutral terminals of the receptacle. Thus, when a household device is plugged into the receptacle the hot or phase wire extends from the power source to the receptacle through the GFCI to the household appliance. Also, a neutral connection extends from the household appliance to the receptacle through the GFCI and onto the power source's neutral terminal. As such, the GFCI is positioned as part of a circuit comprising the power source, the conductors connecting the power source to the receptacle, conductors connecting the receptacle to the appliance and conductors from the appliance to the receptacle and back to the power source. There is a switching device within the GFCI that—when closed—allows the current in the circuit to flow from the power source through the GFCI to the appliance and from the appliance back to the receptacle through the GFCI and back to the power source. Circuit interrupting devices are designed to detect current imbalances and activate their switching device so as to disconnect power from the receptacle thus disconnecting power from a household device plugged to the receptacle when a ground fault is detected.

Presently available circuit interrupting devices, such as the device described in commonly owned U.S. Pat. No. 4,595,894, use a trip device to mechanically break an electrical connection between one or more input and output conductors of the circuit interrupting device. Such devices are resettable after the detection of a ground fault, for example. In particular, a trip device is used to cause the mechanical breaking of the circuit. The trip device includes a solenoid (or trip coil). As a feature to test the trip device and circuitry used to sense faults, a test button is used to initiate a manual test of the GFCI. In addition, a reset button is used to reset the electrical connection between input and output conductors of the GFCI.

Electrical receptacles within which are located circuit interrupting devices (such as GFCIs) have a line side, which is connectable to an electrical power supply, and a load side, which is connectable to one or more loads (e.g., other receptacles). Where a circuit interrupting device includes a user accessible connection, the load side connection and user accessible connection are typically electrically connected to each other. An example of the user accessible connection is a two hole or three hole receptacle used for AC outlets; the connection is implemented as receptacle terminal in which a plug can be connected providing power to an electrical household device, for example. Wires from the power source are connected to the line side of the GFCI receptacle and wires from one or more loads (e.g., other receptacles) are connected to the load side of the GFCI receptacle. Instances, however, may occur where the circuit interrupting device is improperly connected to the external wires so that the load wires are connected to the line side connection and the line wires are connected to the load side connection; this is known as reverse wiring. In the event the circuit interrupting device is reverse wired, fault protection to the user accessible load connection may be eliminated, even if fault protection to the load side connection remains. Thus, there is a need for electrical receptacles that are capable of detecting when reverse wiring has occurred.

Moreover, in an effort to limit the exposure of children to electrical shock, the National Electrical Code (NEC) requires that in buildings where the predominant function of such buildings is to provide shelter for children (e.g., schools, nurseries, daycare facilities, hospitals, residential housing), tamper-resistant electrical receptacles and ground fault circuit interrupters (GFCI) should be designed within an electrical distribution system throughout such residential or commercial buildings. In particular, since a large percentage of electrical receptacles used in residential buildings are installed near the floor, a person, such as a young child or infant, for example, can insert small elongated articles into the cover apertures of the electrical receptacle. More particularly, if the child inserts an object made of conductive material including but not limited to a metal article, electrical shock may result. Another possibility is where an infant or a young child places his or her mouth over an electrical receptacle. Accordingly, a burn or shock may result when the child's wet mouth makes contact with one of the terminals; this is because a path is caused to exist from the hot receptacle terminal through the child to ground creating a ground fault. Ground fault circuit interrupters, however, only disconnect the power supplied to the circuit after a child has made contact with a conductor. Thus, without a tamper resistant electrical receptacle, a child may still experience an electrical shock.

Commonly owned, co-pending patent application Ser. No. 10/690,776, filed Oct. 22, 2003 which is incorporated herein in its entirety by reference, describes a family of resettable circuit interrupting devices (e.g., GFCI receptacles) capable of preventing electric power from being accessible to users of such devices when these devices are reverse wired. Each device has a reset lockout system that prevents the device from being reset when the device is not operating properly. When the device is not reset and if such device is reverse wired, no power is available to any user accessible receptacles and/or plugs located on the face of the devices. The device is preferably shipped in a trip condition, where no electrical connection exists between line and load terminals and no electrical connection exists between load and face terminals. Thus, in the trip condition the three terminals are electrically isolated from each other. If the device is wired in reverse, the device cannot be reset.

However, presently there are no devices within the family of resettable circuit interrupting devices having reverse wiring protection (e.g., such as a shutter lock) that includes a tamper-proof feature. Therefore, there is a need for a simple, effective, efficient, low-cost electrical receptacle that is tamper-proof and provides protection from reverse wiring.

SUMMARY

The present disclosure is directed to a receptacle coupled to a tamper-resistant device comprising shutters. In a preferred exemplary embodiment, the shutters prevent access to the face terminals if an object is incorrectly inserted into the receptacle. In addition, the present disclosure can be incorporated into a GFCI which comprises a circuit interrupting circuit. Furthermore, the shutters of the present disclosure may also operate in conjunction with the circuit interrupting portion of the receptacle to either permit or prevent access to the face terminals based on the state of the circuit interrupting device.

In one aspect of the present disclosure a receptacle is presented. The receptacle includes a front surface including one or more slots for receiving contact blades; a rear surface including one or more terminals for connecting the contact blades to a power source, the one or more terminals being line terminals and load terminals; a shutter positioned between the front surface and the rear surface of the receptacle, the shutter configured to be misaligned in relation to the one or more slots in order to obstruct a direct path between the contact blades and the one or more terminals, wherein insertion of an object in the one or more slots causes displacement of the shutter; and a shutter lock operatively connected in the receptacle to receive power from the power source connected to the receptacle.

In another aspect of the present disclosure a different receptacle is presented. The receptacle includes a front surface and a rear surface for connecting a compatible object to a power source; a shutter positioned between the front surface and the rear surface, the shutter configured to prevent a non-compatible object from being inserted into one or more slots of the front surface of the receptacle; and a shutter lock operatively connected in the receptacle to receive power from a power source connected to the receptacle preventing displacement of said shutter when the receptacle is reverse-wired.

In another aspect of the present disclosure a receptacle only having a shutter is presented. The receptacle includes a front surface and a rear surface for connecting a compatible object to a power source; and a shutter positioned between the front surface and the rear surface, the shutter configured to prevent a non-compatible object from being inserted into one or more slots of the front surface of the receptacle.

In another aspect of the present disclosure a method for combining a tamper-resistant device and a reverse-wiring circuit within a receptacle is presented. The method for combining a tamper-resistant device and a shutter lock within a receptacle, the receptacle having a front surface including one or more slots for receiving contact blades and a rear surface including one or more terminals for connecting the contact blades to a power source, the one or more terminals being line terminals and load terminals, the tamper-resistant device positioned between the front surface and the rear surface of the receptacle and configured to be misaligned in relation to the one or more slots in order to obstruct a direct path between the contact blades and the one or more terminals, wherein insertion of an object in the one or more slots causes displacement of the tamper-resistant device, the method including applying power from the power source to the line terminals of the receptacle in order to release a pivoting locking bar; and inserting the contact blades to move the tamper-resistant device for allowing an electrical connection between the contact blades and the one or more terminals of the receptacle.

In another aspect of the present disclosure a method for combining a tamper-resistant device and a reverse-wiring circuit within a receptacle is presented. The method for combining a tamper-resistant device and a shutter lock within a receptacle, the receptacle having a front surface and a rear surface for connecting a compatible object to a power source, the tamper-resistant device positioned between the front surface and the rear surface and configured to prevent a non-compatible object from being inserted into one or more slots of the front surface of the receptacle, the shutter lock operatively connected in the receptacle to receive power from a power source connected to the receptacle, the method including releasing a pivoting locking bar; and inserting the contact blades to move the tamper-resistant device for allowing an electrical connection between the contact blades and the one or more terminals of the receptacle.

BRIEF DESCRIPTION OF THE DRAWINGS

For a more complete understanding of the exemplary embodiment of the present disclosure and the advantages thereof, reference is now made to the following description taken in conjunction with the accompanying drawings in which like reference numbers indicate like features and wherein.

DETAILED DESCRIPTION

The following description is presented to enable one of ordinary skill in the art to make and use the disclosure and is provided in the context of a patent application and its requirements. Various modifications to the disclosed embodiments will be readily apparent to those skilled in the art and the generic principles herein may be applied to other embodiments. Thus, the present disclosure is not intended to be limited to the embodiments shown but is to be accorded the broadest scope consistent with the principles and features described herein.

I. GFCI Operation

Referring to FIGS. 1-6, there is shown a sequence of how the GFCI is reset from a tripped condition. When the GFCI device is in a tripped condition, the line, load and face terminals are electrically isolated from each other because the movable bridges are not engaged to any of the terminals.

Figure 1:
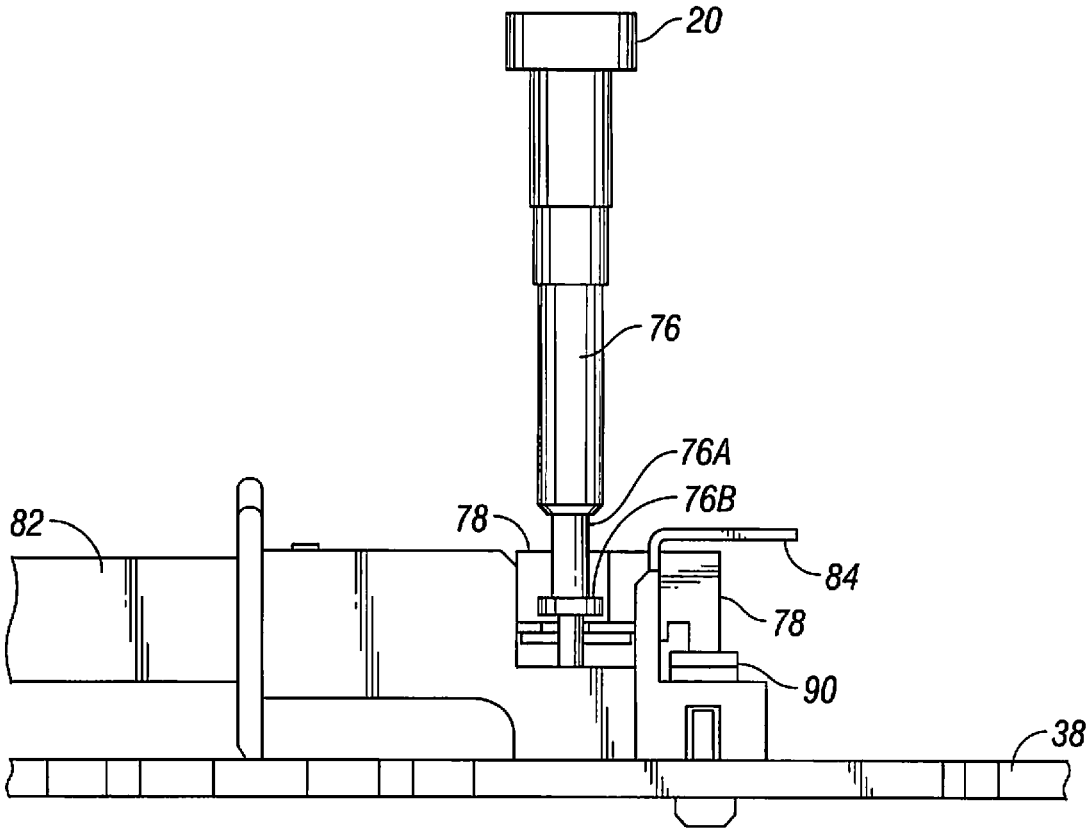
FIG. 1 Prior Art
FIGS. 1-6 show the sequence of operation when a circuit interrupting device in accordance with the present disclosure is reset from a tripped state.

Referring to FIG. 1 there is shown the positioning of a reset button 20, reset pin 76, reset pin lower portion 76A and disk 76B when the device is in the tripped condition. In the tripped condition, the lifter 78 positioned below the movable bridges (not shown) does not engage the movable bridges. Reset button 20 is in its fully up position. Latch 84 and lifter 78 are such that the openings of the latch 84 and the lifter 78 are misaligned not allowing disk 76B to go through the openings. Furthermore, a portion of lifter 78 is positioned directly above test arm 90 but does not engage test arm 90. One side of the lifter 78 is positioned adjacent a bobbin 82. A portion of the bobbin 82 is mounted on a printed circuit board 38.

Figure 2:
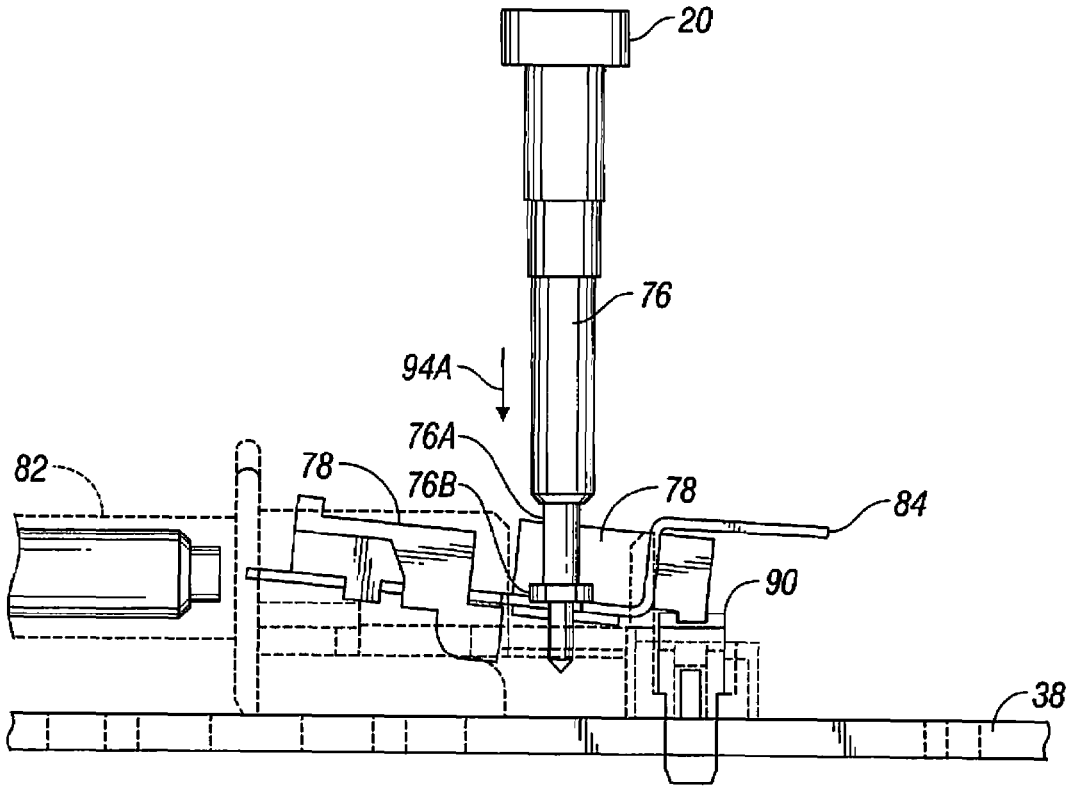
FIG. 2 Prior Art

In FIG. 2, to initiate the resetting of the GFCI device, reset button 20 is depressed (in the direction shown by 94A) causing flange 76B to interfere with latch plate 84 which causes lifter 78 to press down on test arm 90 of. As a result, test arm 90 makes contact with test pin (not shown). One side of the lifter 78 is positioned adjacent a bobbin 82. A portion of the bobbin 82 is mounted on a printed circuit board 38.

Figure 3:
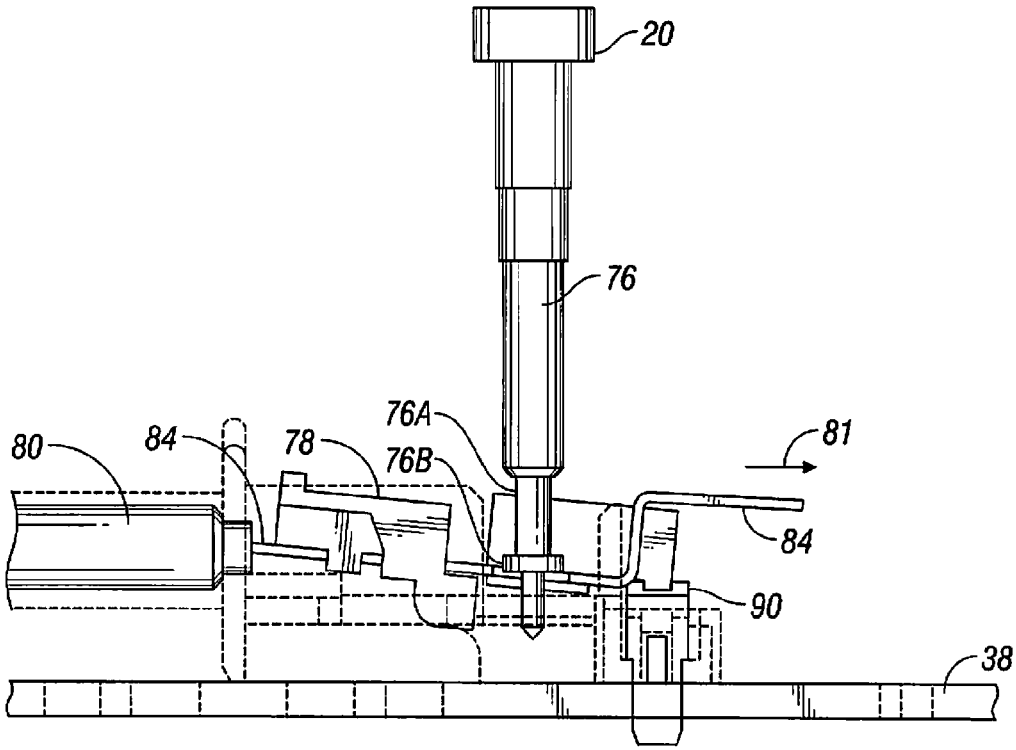
FIG. 3 Prior Art

In FIG. 3, when test arm 90 makes contact with the test pin, a sensing circuit (not shown) is triggered, thus energizing the coil causing plunger 80 to be momentarily pulled into the bobbin 82 engaging latch plate 84 and more specifically pushing latch plate 84 in the direction shown by arrow 81.

Figure 4:
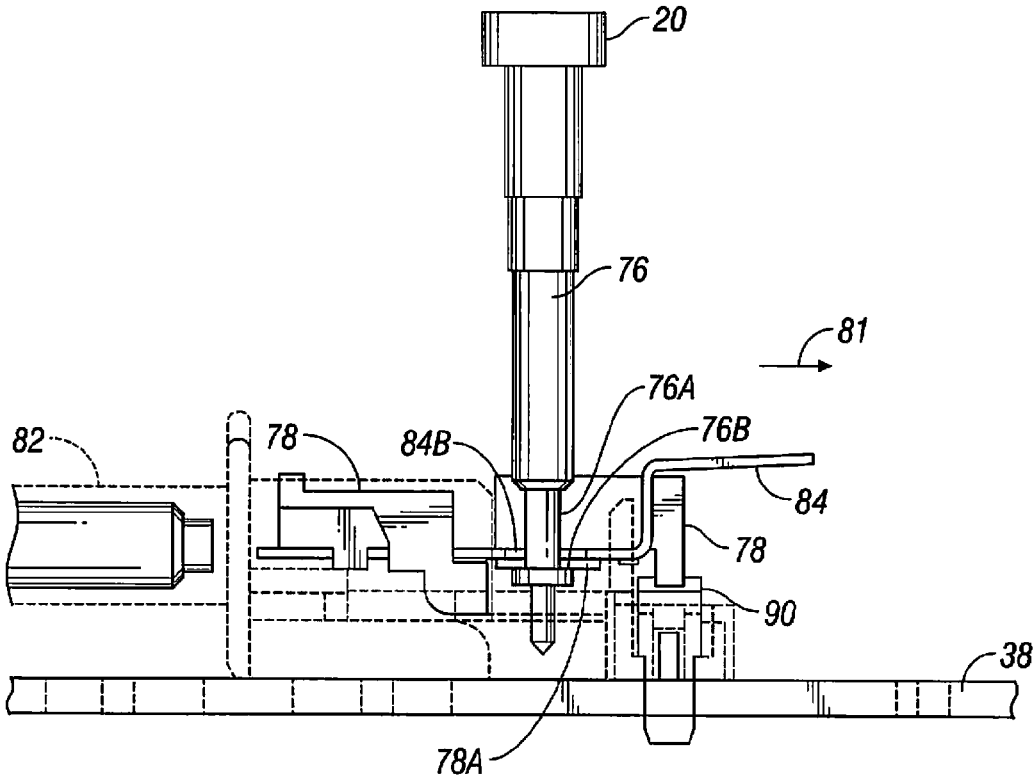
FIG. 4 Prior Art

In FIG. 4, the latch plate 84, when pushed by plunger 80, slides along lifter 78 (in the direction shown by arrow 81) so as to align its opening with the lifter opening allowing flange 76B and part of lower reset pin portion 76A to extend through the openings 84B, 78A.

Figure 5:
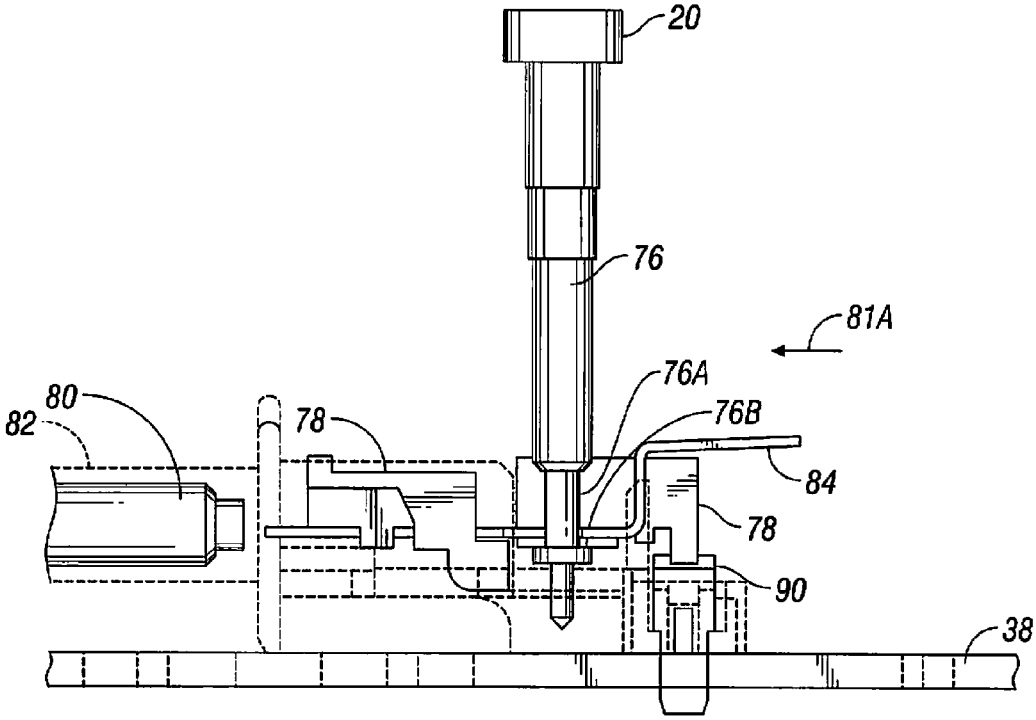
FIG. 5 Prior Art

In FIG. 5, the latch plate 84 then recoils back (in the direction shown by arrow 81A) and upon release of the reset button 20, test arm 90 also springs back disengaging from contact with the test pin.

Figure 6:
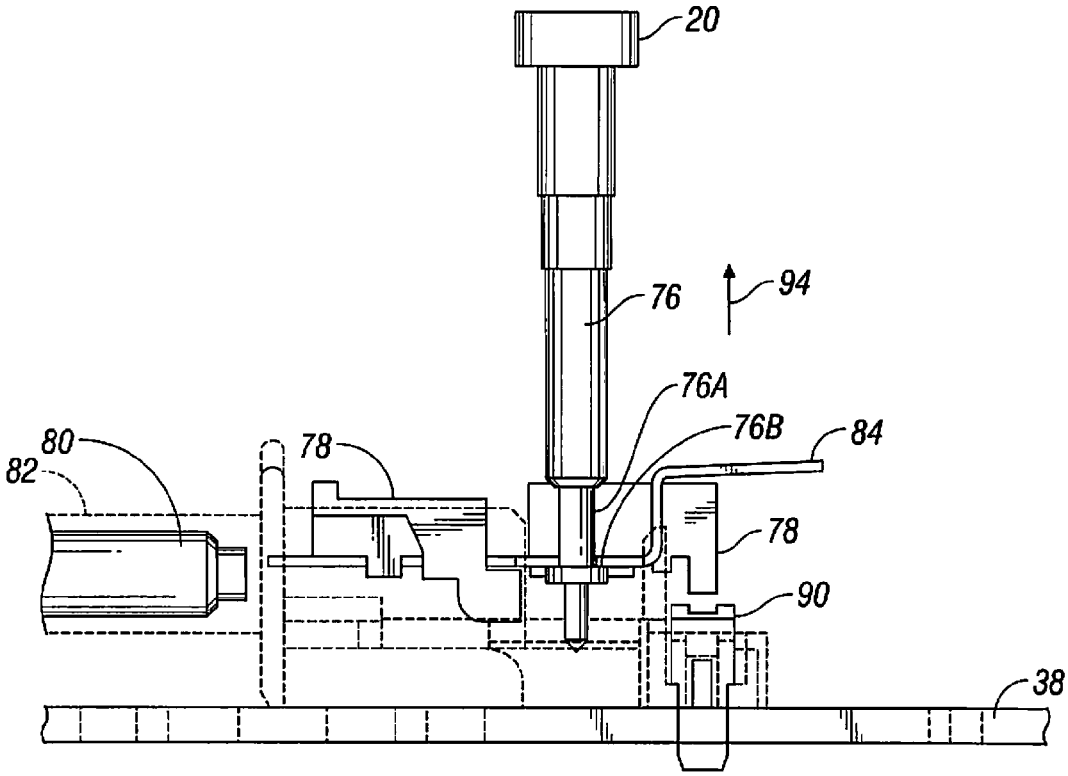
FIG. 6 Prior Art

In FIG. 6, the recoiling of the latch plate 84 causes the opening 84B (shown in FIG. 4) to once again be misaligned with opening 74A (shown in FIG. 4) thus trapping flange 76B underneath the lifter 78 and latch plate 84. When reset button is released the biasing of the reset pin 76 in concert with the trapped flange 76B raise the lifter 78 and latch plate 84 causing the lifter 78 (located underneath the movable bridges) to engage the movable bridges. In particular, the connecting portions of the movable bridges are bent resulting in the line terminals, load terminals and face terminals being electrically connected to each other. The GFCI is now in the reset mode meaning that the electrical contacts of the line, load and face terminals are all electrically connected to each other allowing power from the line terminal to be provided to the load and face terminals. The GFCI remains in the reset mode until the sensing circuit detects a fault or the GFCI is tripped purposely by depressing the test button 22 (discussed with reference to FIGS. 7-10).

When the sensing circuit detects a condition such as a ground fault for a GFCI or other conditions (e.g., arc fault, immersion detection fault, appliance leakage fault, equipment leakage fault), the sensing circuit energizes the coil causing the plunger 80 to engage the latch 84 resulting in the latch opening 84B being aligned with the lifter opening 78A allowing the lower portion of the reset pin 76A and the disk 76B to escape from underneath the lifter 78 causing the lifter 78 to disengage from the movable bridges which, due to their biasing, move away from the face terminals contacts and load terminal contacts. As a result, the line, load and face terminals are electrically isolated from each other and thus the GFCI device is in a tripped state or condition.

The GFCI device of an exemplary embodiment of the present disclosure can also enter the tripped state by pressing the test button 22. In FIGS. 7-10, there is illustrated a sequence of operation showing how the device can be tripped using the test button 22.

Similar elements described with reference to FIGS. 1-6 will not be described with reference to FIGS. 7-10.

Figure 7:
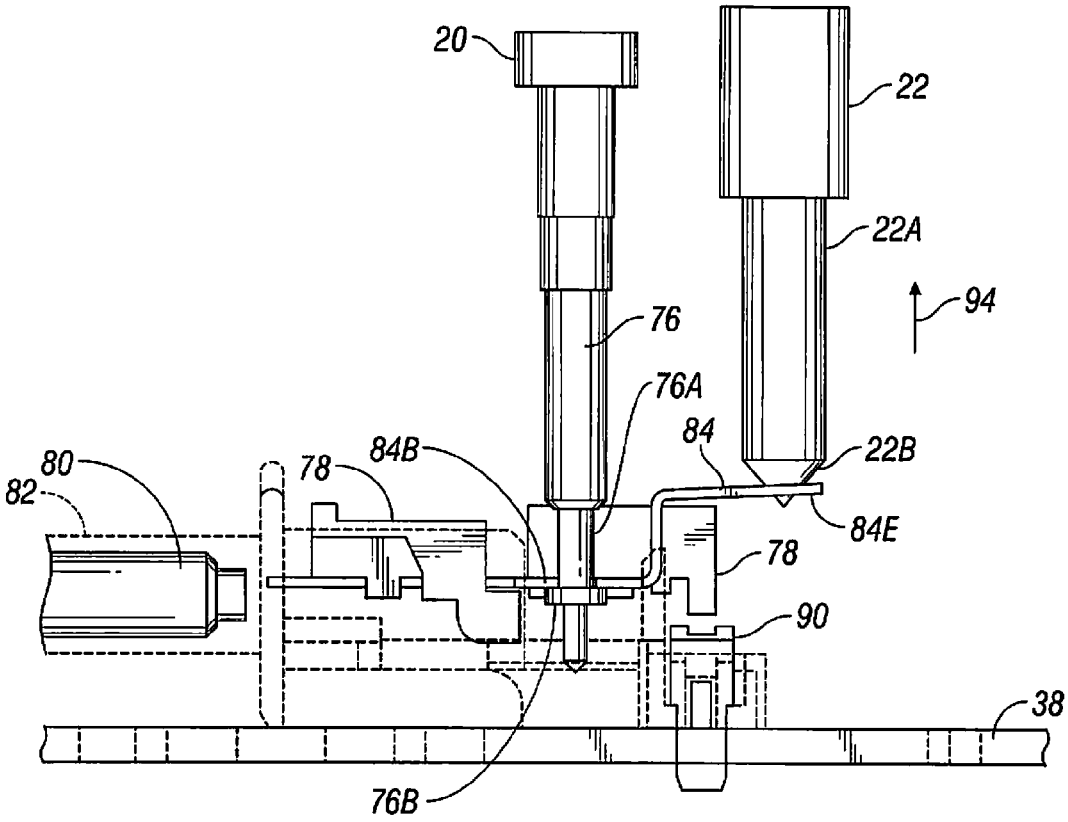
FIG. 7 Prior Art
FIGS. 7-10 show the sequence of operation when a circuit interrupting device in accordance with the present disclosure is tripped while in a reset state.

In FIG. 7, while the device is in the reset mode, test button 22 is depressed. Test button 22 has test button pin portion 22A and cam end portion 22B connected thereto and is mechanically biased upward in the direction shown by arrow 94. The cam end portion 22B is preferably conically shaped so that when it engages with the hooked end 84E of latch plate 84 a cam action occurs due to the angle of the end portion of the test button pin 22A.

Figure 8:
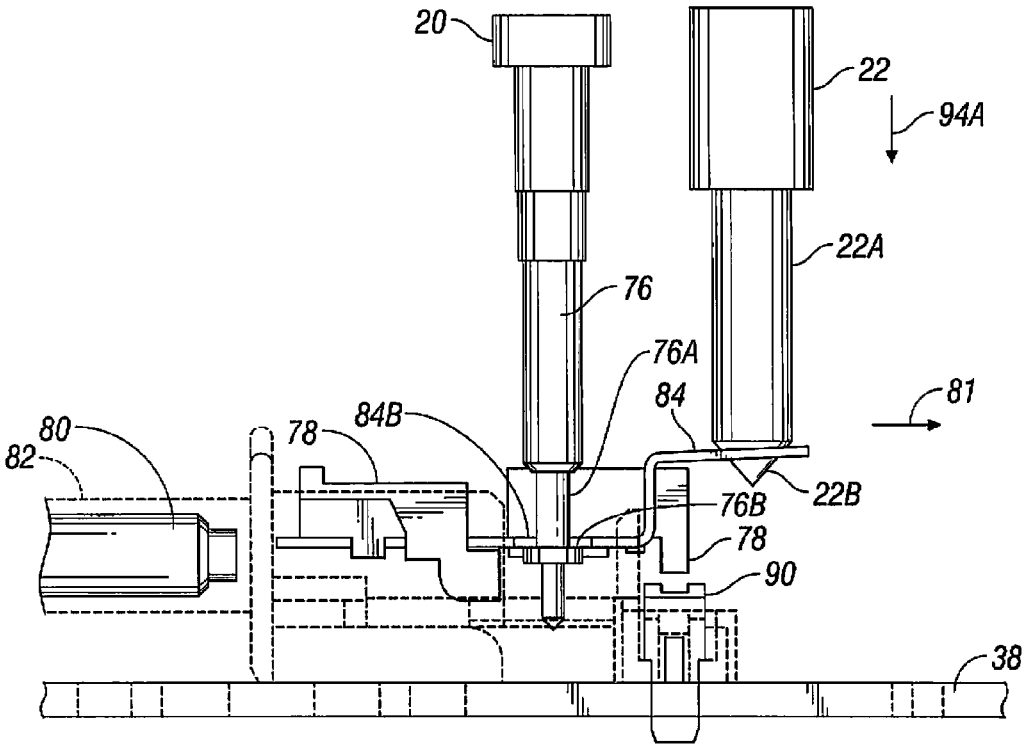
FIG. 8 Prior Art

In FIG. 8, the cam action is the movement of latch plate 84 in the direction shown by arrow 81 as test button 22 is pushed down (direction shown by arrow 94A) causing latch plate opening 84B to be aligned with lifter opening 78A.

Figure 9:
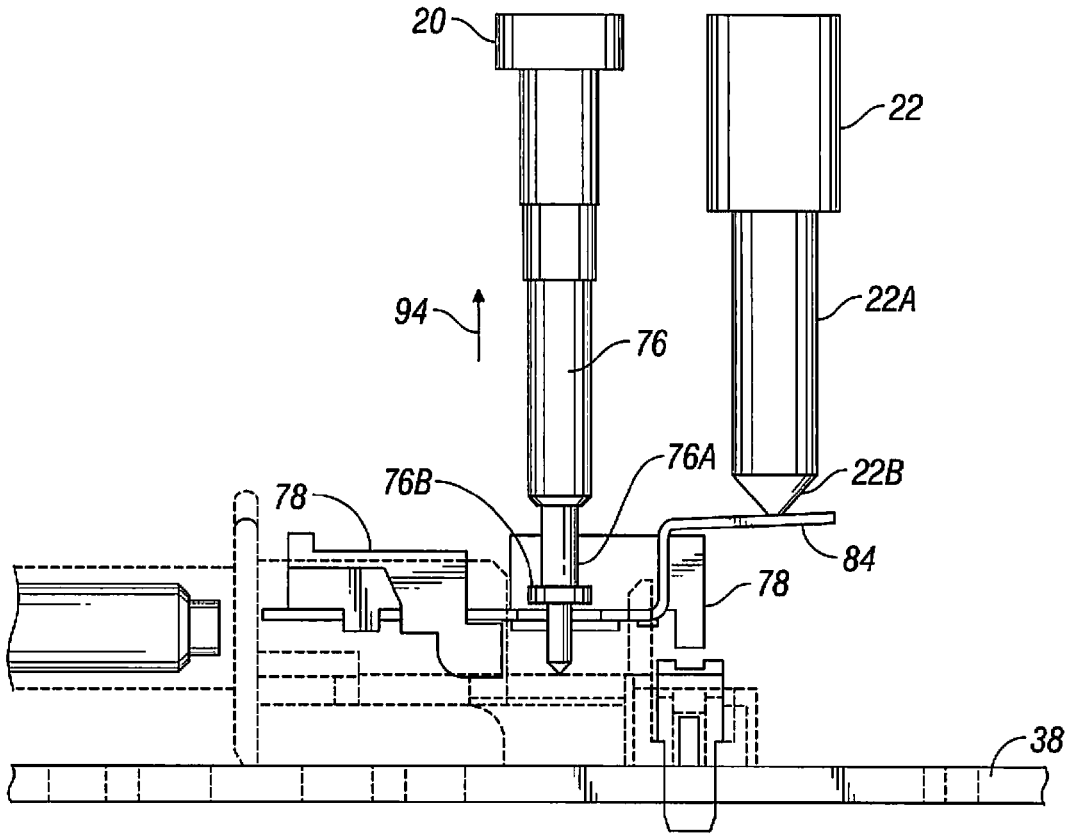
FIG. 9 Prior Art

In FIG. 9, the alignment of the openings (78A, 84B) allows the lower portion of the reset pin 76A and the disk 76B to escape from underneath the lifter 78 causing the lifter 78 to disengage from the movable bridges which, due to their biasing, move away from the face terminals contacts and load terminal contacts. The test button 20 is now in a fully up position. As a result, the line, load and face terminals are electrically isolated from each other and thus the GFCI device is in a tripped state or condition (see FIG. 1).

Figure 10:
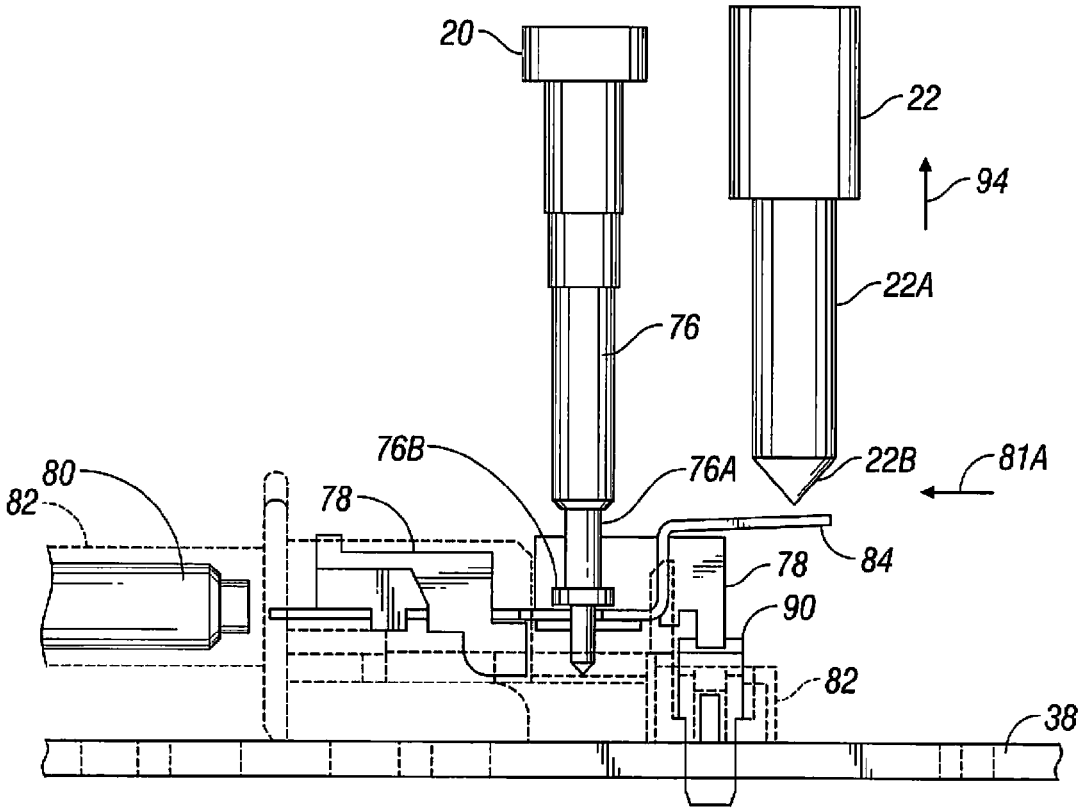
FIG. 10 Prior Art

In FIG. 10, the test button 22 is released allowing its bias to move it upward (direction shown by arrow 94) and disengage from the hook portion 84E of latch plate 84. The latch plate 84 recoils in the direction shown by arrow 81A thus causing the opening in the latch plate 84 to be misaligned with the opening of the lifter 78. The device is now in the tripped position. It should be noted that once the device of an exemplary embodiment of the present disclosure is in a tripped position, depressing the test button does not activate any function because at this point the latch 84 cannot be engaged by the angled end of the test button 22. The test button 22 performs the trip function after the device has been reset.

The GFCI device of the present exemplary embodiment of the disclosure, once in the tripped position, is not permitted to be reset (by pushing the reset button) if the circuit interrupting portion is non-operational; that is if any one or more of the components of the circuit interrupting portion is not operating properly, the device cannot be reset. Further, if the sensing circuit is not operating properly, the device can not be reset. The reset lockout system of the present exemplary embodiment of the disclosure can be implemented in an affirmative manner where one or more components specifically designed for a reset lockout function are arranged so as to prevent the device from being reset if the circuit interrupting portion or if the sensing circuit are not operating properly. The reset lockout system can also be implemented in a passive manner where the device does not enter the reset mode if any one or more of the components of the sensing circuit or if any one or more of the components of the circuit interrupting portion is not operating properly; this passive reset lockout approach is implemented in the present exemplary embodiment of the disclosure.

It should be noted that the circuit interrupting device of the present exemplary embodiment of the disclosure may have a trip portion that operates independently of the circuit interrupting portion so that in the event the circuit interrupting portion becomes non-operational the device can still be tripped. Preferably, the trip portion is manually activated and uses mechanical components to break one or more conductive paths. However, the trip portion may use electrical circuitry and/or electro-mechanical components to break either the phase or neutral conductive path or both paths. Additionally, the trip portion may use any suitable means to break one or more of the conductive paths.

II. Tamper Resistant Shutter with Reverse-Wiring Protection Circuit

In addition to tamper resistant shutters providing child safety protection to a receptacle, the tamper resistant shutter of the present exemplary embodiment provides a second function—not allowing the device to be used when the device is tripped. On initial shipment, the receptacle may be shipped in the tripped state in order to facilitate checking for reverse wiring (e.g., via a shutter lock that is operatively connected in the receptacle to receive power from the power source connected to the receptacle). In particular, a pivoting "locking bar" may be positioned such that, when the GFCI is in the tripped state, the bar blocks the movement of the tamper resistant shutters; the electrical receptacle is thus in a locked position.

In this locked position, even if an electrical plug having prongs were properly inserted into the apertures of the receptacle's cover, these prongs would be prevented from making contact with the Phase and Neutral contacts of the receptacle, i.e., the prongs would be blocked by the shutters. When a receptacle configured in accordance with the preferred exemplary embodiment of the present disclosure is properly installed or wired, the receptacle is reset with the use of a lifter that closes the contacts connecting the line terminals of the receptacle to the load and face terminals of the receptacle.

Specifically, the upward motion of the lifter can also be used to force a mechanical arm, which is connected to the center of the pivoting locking rod, to also move upward. This upward motion of the mechanical arm causes the pivoting locking bar to pivot downward out of each slot in the tamper resistant shutters. Specifically, the center of the locking rod may sit between two fulcrums such that when the center of the locking rod is pushed upwards, the two ends of the locking rod pivot downwards. As a result, the two ends of the locking bar move out of a slot in each of the tamper resistant shutters. In the preferred exemplary embodiment there is a tamper resistant shutter for each outlet. In a dual receptacle, there is one shutter for the top outlet and one for the bottom outlet. However, the present disclosure is not limited to a two shutter arrangement. Whether the receptacle has one or more shutters, the disclosure requires a locking bar that is released when power is applied to the line side of the receptacle. When the two ends of the locking bar are clear from the two shutters, the shutters are free to move laterally if an electrical plug having prongs is properly inserted into the outlet. The end result is that the pivoting locking bar does not block the movement of the tamper resistant shutters and the receptacle is placed in an unlocked position allowing a user to insert a plug with prongs in the entry ports of the electrical receptacle when the prongs make electrical contact with the face terminals.

Figure 11:
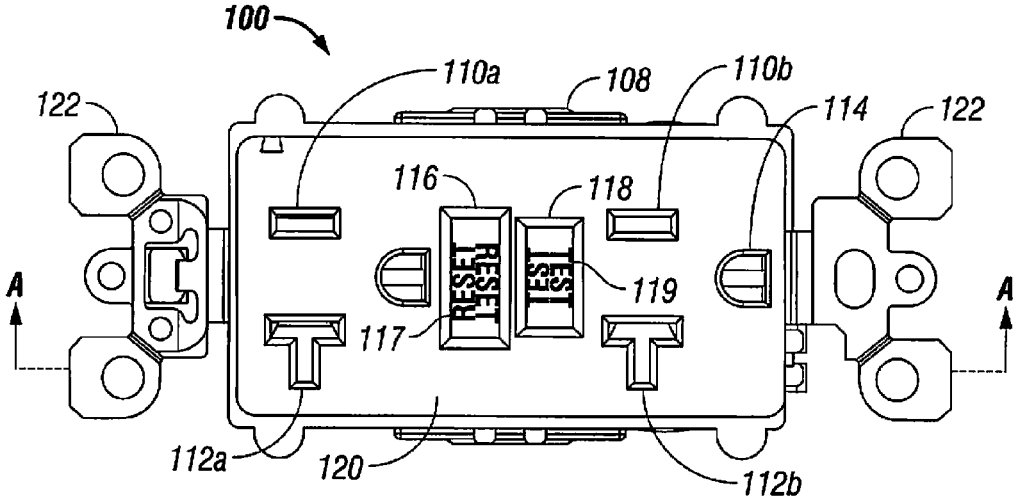
FIG. 11 illustrates a front view of the electrical receptacle in accordance with an embodiment of the present disclosure.

FIGS. 11-14A illustrate the operation of the electrical receptacle having a GFCI and tamper resistant shutters disposed therein in accordance with the illustrated preferred exemplary embodiment of the present disclosure. Turning now to FIG. 11, the electrical receptacle 100 has a face or cover portion 120. The face portion 120 has entry ports 110*a*, 110*b*, and 112*a* for receiving normal or polarized prongs of a male plug of the type normally found at the end of an electrical appliance (e.g., a lamp) or appliance cord set (not shown), as well as ground-prong-receiving openings 114 to accommodate a three-wire plug. The receptacle also includes a mounting strap 122 used to fasten the receptacle to a junction box. Face or cover portion 120 is mounted on housing 108. Optionally, the face portion may be an integral part of the housing.

A test button 118 may extend through opening 119 in the face portion 120. The test button 118 may be used to activate a test operation, that tests the operation of the circuit interrupting device disposed in the housing 108. Optionally, the test operation may test for any desired condition. The circuit interrupting portion, to be described in more detail below, is used to break electrical continuity in one or more conductive paths between the line and load side of the device. A reset button 116 which may form a part of the reset portion may extend through opening 117 in the face portion 120. The reset button may be used to activate a reset operation, which reestablishes electrical continuity in the open conductive paths.

Figure 12:
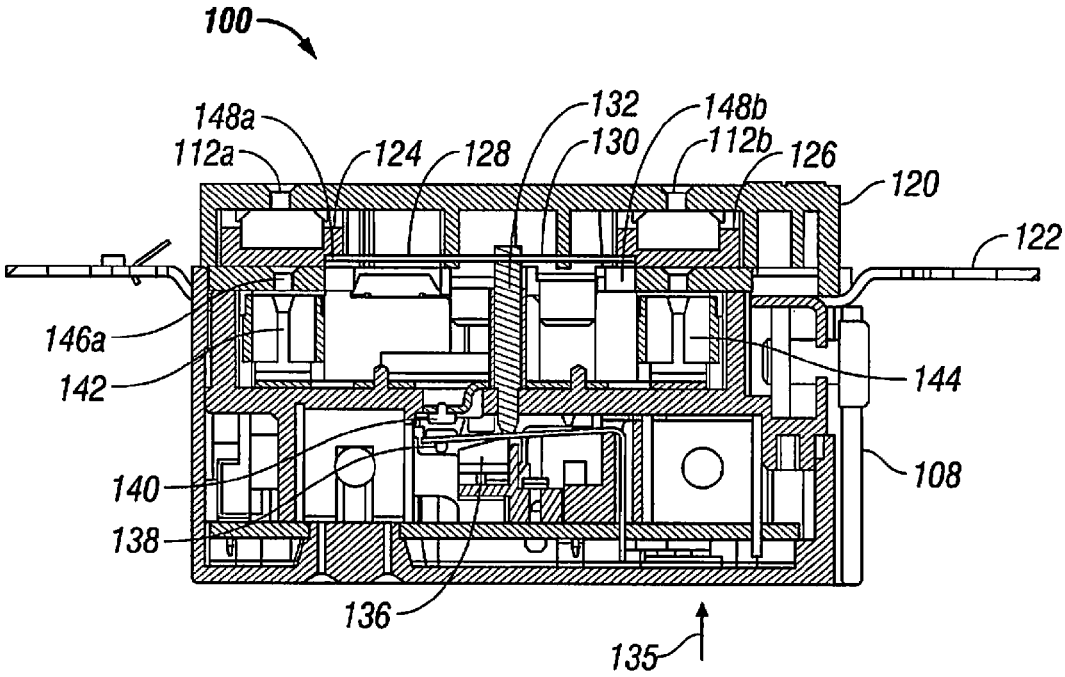
FIG. 12 displays a cross-sectional view of FIG. 11 taken along Section line A-A where the cut extends through receptacle when the pivoting locking rod is in the locked position.

FIG. 12 represents a cross-section view of FIG. 11 taken along Section line A-A where the cut extends through receptacle 100 wherein the pivoting locking rod comprising sections 128, 130 is in the locked position. Section line A-A extends through receptacle 100 across entry ports 112*a* and 112*b*. As shown in FIG. 12, the face or cover portion 120 has entry ports 112*a* and 112*b* aligned with tamper resistant shutters 124 and 126, respectively.

During normal operation, when a pair of normal or polarized prongs of a male plug of the type normally found at the end of an appliance cord set (not shown) are inserted in entry port 112*a*, shutter 124 shifts to enable the prong to pass through aperture 146*a* making contact with receptacle terminals 142, wherein entry port 112*a* aligns with shutter 124. Similarly, the pair of prongs may be inserted in entry port 112*b*, such that shutter 126 shifts to enable the prongs to pass through aperture 146*b* (shown in FIG. 13) making contact with receptacle (or face) terminal 144.

Normal operation, however, is hindered in the locked position where the ends of the pivoting locking bar sections 128, 130 are positioned in slots 148*a* and 148*b* of tamper resistant shutters 124 and 126, respectively. It is in this locking position that receptacle 100 may be shipped to ensure that reverse wiring is prevented or corrected during installation of the unit.

The GFCI receptacle is in the tripped condition as contact 140 is disconnected (or is not making contact with) contact 138. In the present exemplary embodiment, contact 138 may be mounted on movable bridge 134 (shown in FIG. 13) and in contact with a mechanical arm 132. Contact 140 is mounted on part of the conductive path for one of the load terminals. It is understood that the other contacts for the line, load and face terminals (although not shown in FIG. 12) are positioned in similar fashion with respect to each other such that when the GFCI receptacle is in the tripped condition, the line, load and face terminals are electrically isolated from each other. In addition, housing 108 includes mounting strap 122 located on two opposing sides of receptacle 100.

Figure 13:
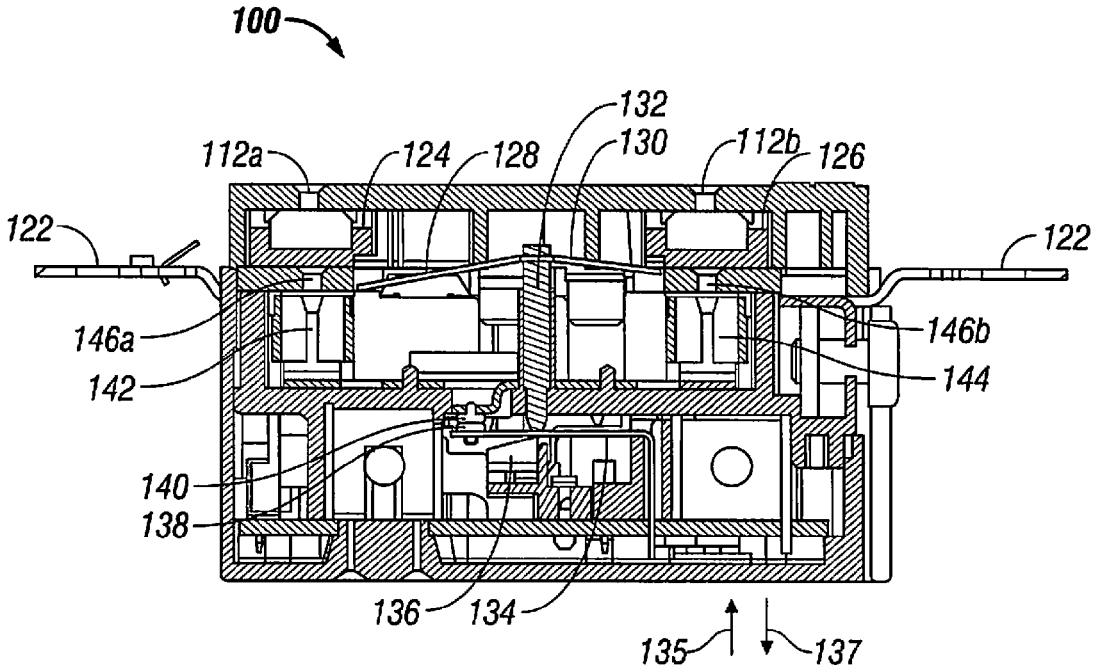
FIG. 13 shows a cross-sectional view of FIG. 11 taken along Section line A-A where the cut extends through receptacle when the pivoting locking rod is in the unlocked position.

Responsive to a correctly wired receptacle 100 that is reset, (i.e., reset button is depressed) lifter 136 shifts upward (i.e., in the direction shown by arrow 135) making contact with movable bridge 134. Thus, in operation as shown in FIG. 13, if the receptacle 100 is wired correctly, lifter 136 responds to a reset operation in the GFCI, by shifting in the direction shown by arrow 135 and making contact with movable bridge 134. Accordingly, contact 138 mounted on movable bridge 134 is shifted in the direction shown by arrow 135 to meet contact 140. When contacts 138 and 140 are engaged, the receptacle 100 is reset. It should be understood that only one set of contacts are shown for ease of explanation; in a typical GFCI two or three sets of contacts mate with each other to reset the device. In this case, as lifter 136 moves in the direction shown by arrow 135 enabling the receptacle 100 to be reset, mechanical arm 132 shifts in the same direction pivoting the sections 128 and 130 of the locking rod. Each respective end of each of the sections 128, 130 of the pivoting locking rod pivots downwards (in the direction shown by arrow 137) out of in each respective tamper resistant shutter 124, 126.

Until receptacle 100 is correctly wired, receptacle 100 remains in the locked position shown in FIG. 12. In particular, the mechanical arm 132 remains in this locked position wherein each end of the pivoting locking bar sections 128, 30 sits in each respective slot 148*a*, 148*b* of the tamper resistant shutters, 124 and 126. Effectively, the use of receptacle 100 is disabled until the receptacle 100 is wired correctly and reset.

Figure 14:
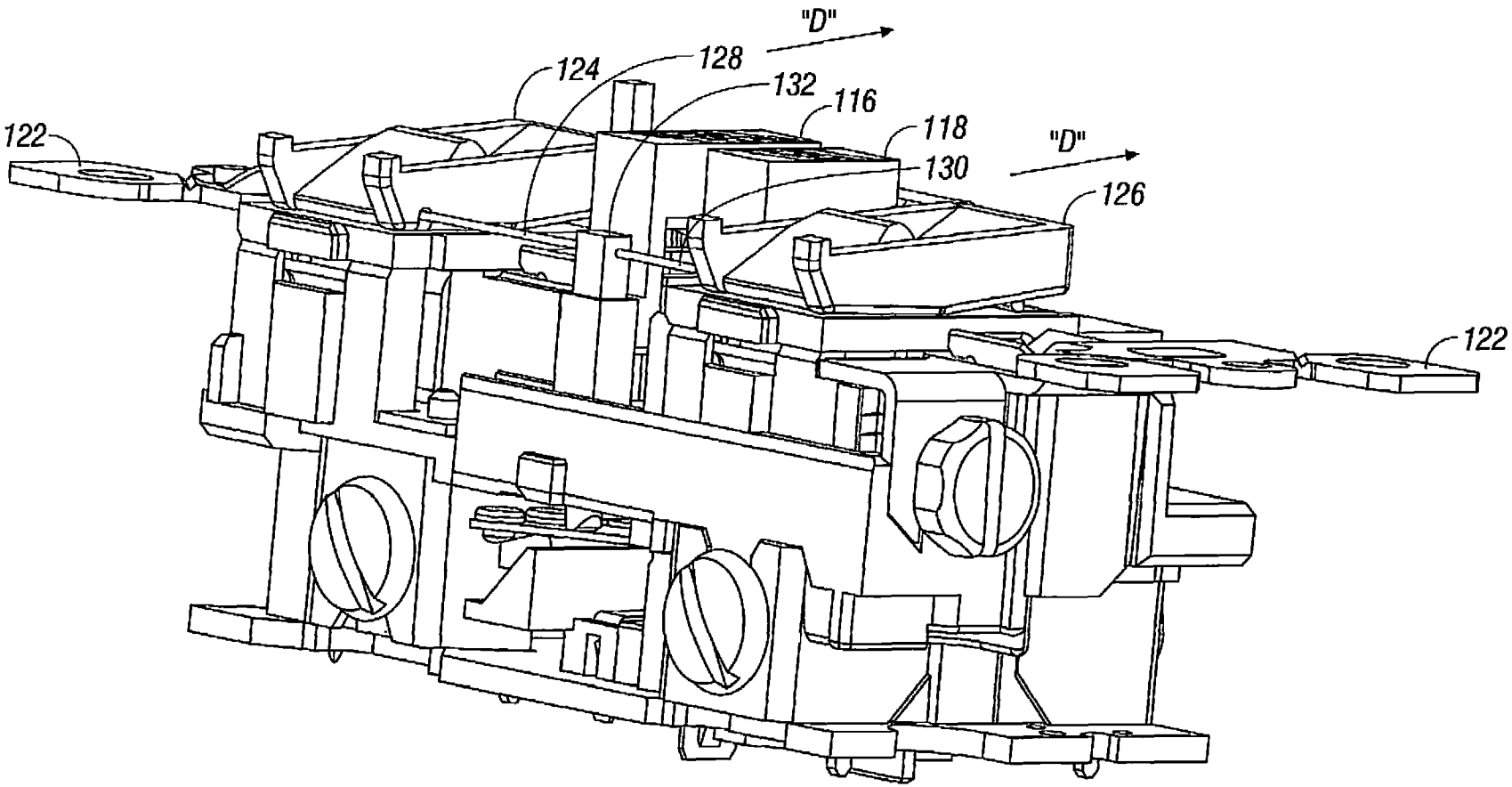
FIG. 14 displays a perspective view of the electrical receptacle of an embodiment of the present disclosure with the cover removed.
Figure 14A:
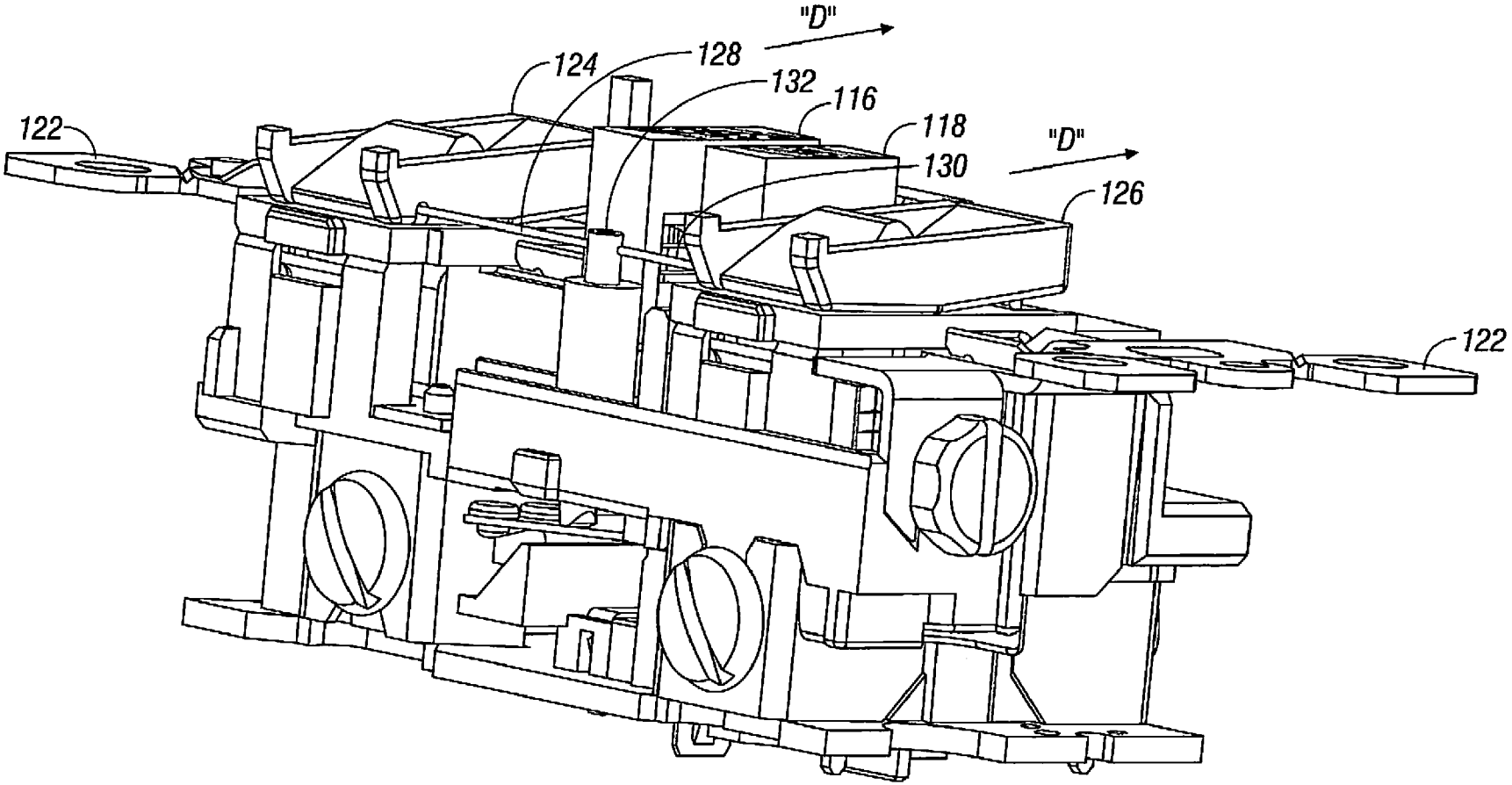
FIG. 14A is a view of the device in FIG. 14 in accordance with another embodiment of the electrical receptacle where a solenoid is coupled to the locking rod instead of a mechanical arm.

FIG. 14 represents a perspective view of the electrical receptacle 100 (shown in FIG. 19) in accordance with the preferred exemplary embodiment of the present disclosure having the cover removed, wherein the receptacle 100 is in the locked position. As shown mechanical arm 132 is in the locked position, wherein each end of the pivoting locking rod sections 128, 130 is held in each respective slot (148*a*, 148*b*-shown in FIG. 20) of the tamper resistant shutters, 124 and 126. With the pivoting locking bar sections 128, 130 in the position shown, the shutters, 124 and 126, are prevented from sliding in the direction shown by arrow "D" when a plug is inserted in either set of entry ports. In addition, reset button 116 and test button 118 are shown.

Figure 22:
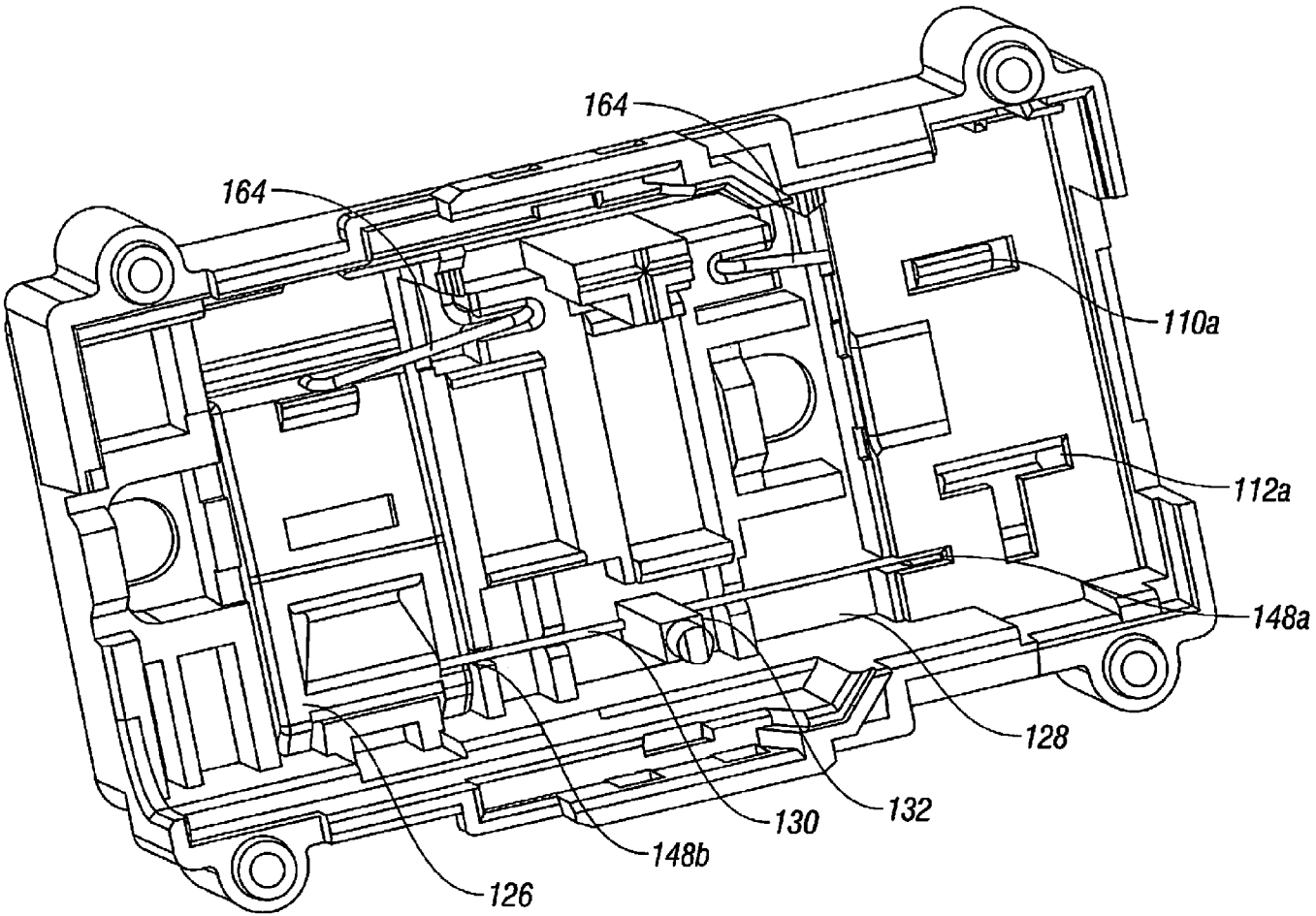
FIG. 22 shows the underside view of FIG. 14 displaying how the pivoting locking rods fit into their respective slots.

FIG. 22 shows the underside view of FIG. 14. For ease of illustration shutter 124 is not shown. However, shutter 126 is shown and the manner in which the end of pivoting locking rod section 130 fits into slot 148*b*. Also, slots 148*a* and 148*b* also include slots made in the housing structure and not only the shutters; this is shown in the way pivoting locking rod 128 fits into slot 148*a*. Also shown are springs 164 that bias the shutters 126 and 126 respectively.

Figure 15:
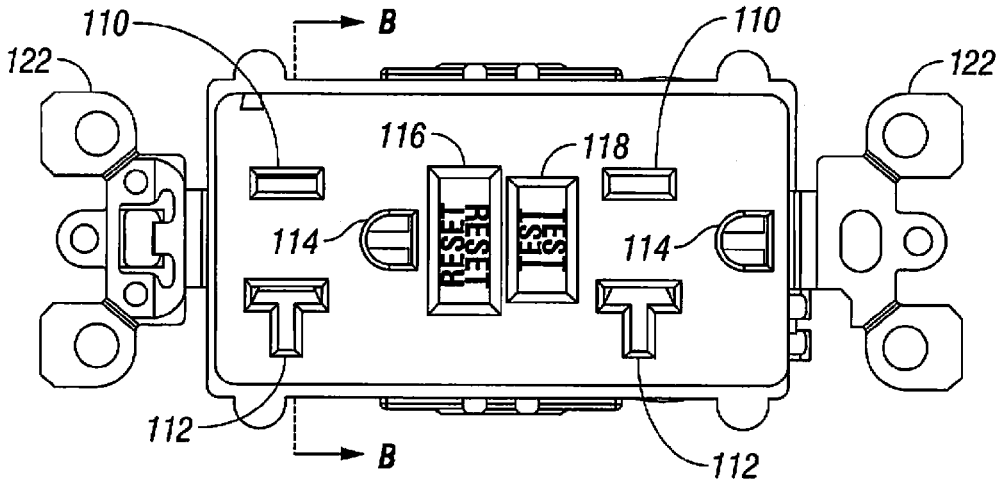
FIG. 15 illustrates a front view of the electrical receptacle of FIG. 11 having cut line B-B.
Figure 16:
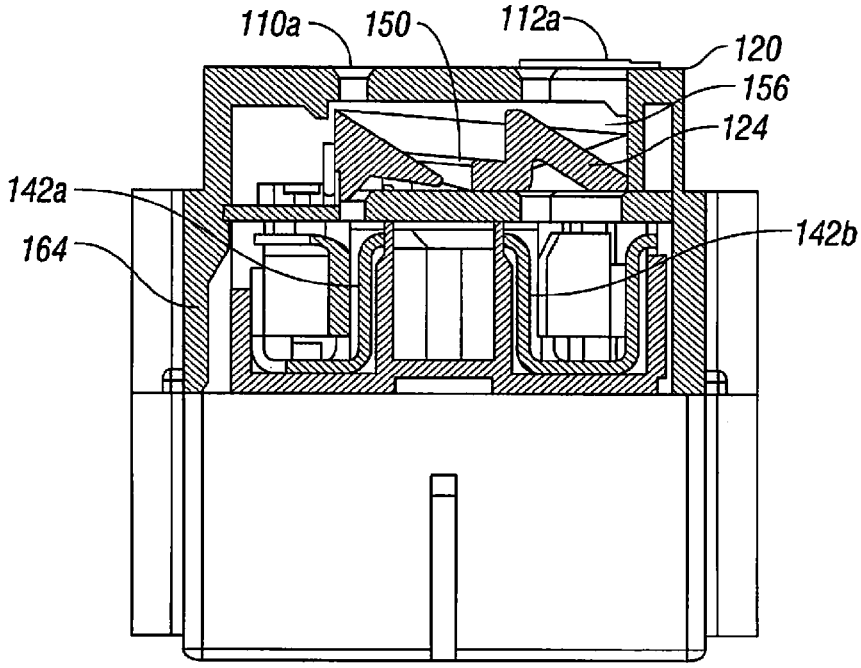
FIG. 16 illustrates a cross-sectional view of FIG. 15 taken along Section line B-B where the cut extends through receptacle when the pivoting locking rod is in the locked position.

FIG. 15 illustrates the same receptacle 100 of FIG. 11 having section line B-B which extends through the center of entry points 110 and 112. FIG. 16 is the corresponding cross-section view of FIG. 15 taken along Section line B-B where the cut extends through receptacle 100 when the pivoting locking bar 128, 130 is in the locked position. As shown tamper resistant shutter 24 includes an aperture 50 that aligns with entry port 110*a* and aperture 145*a* when the shutter is in the unlocked position as shown in FIG. 17.

In FIG. 16, however, spring 164 is biased to keep shutter 124 in the position shown. Shutter 124 shifts in the direction shown by arrow "F" when a pair of prongs inserted in apertures 110*a* and 112*a* overcomes the bias force of spring 164 to make contact with receptacle terminals 142*a* and 142*b* and the electrical receptacle has been reset. Effectively, during installation or at any time when the receptacle 100 is reversed wired and tripped, the receptacle 100 cannot be used by a user due to the pivoting locking rod sections 128, 130 and the tamper resistant shutters 124 and 126.

Figure 17:
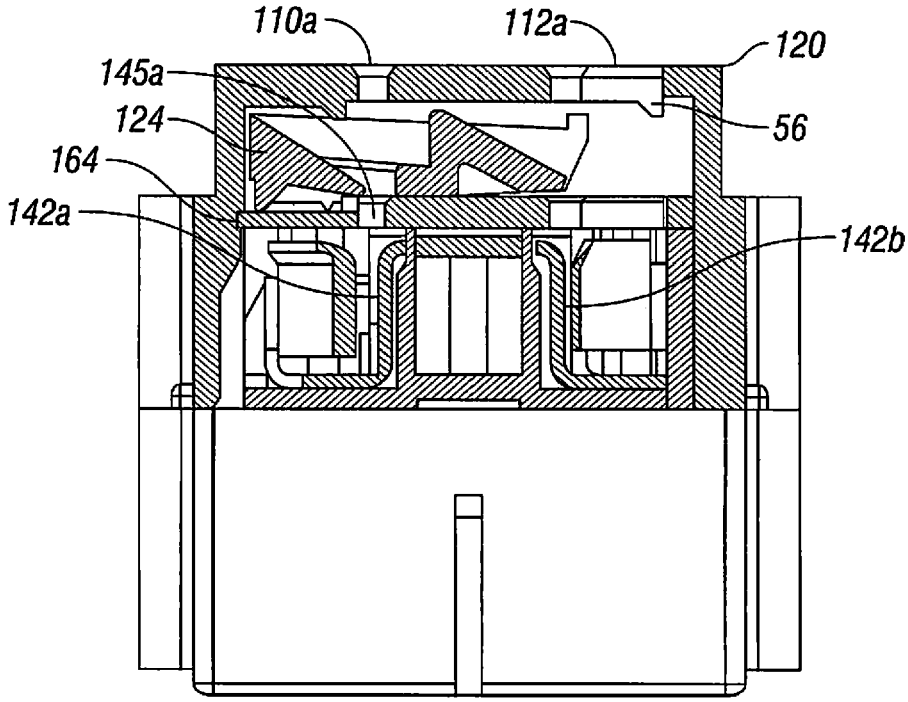
FIG. 17 illustrates a front view of the electrical receptacle of FIG. 11 having cut line C-C.
Figure 18:
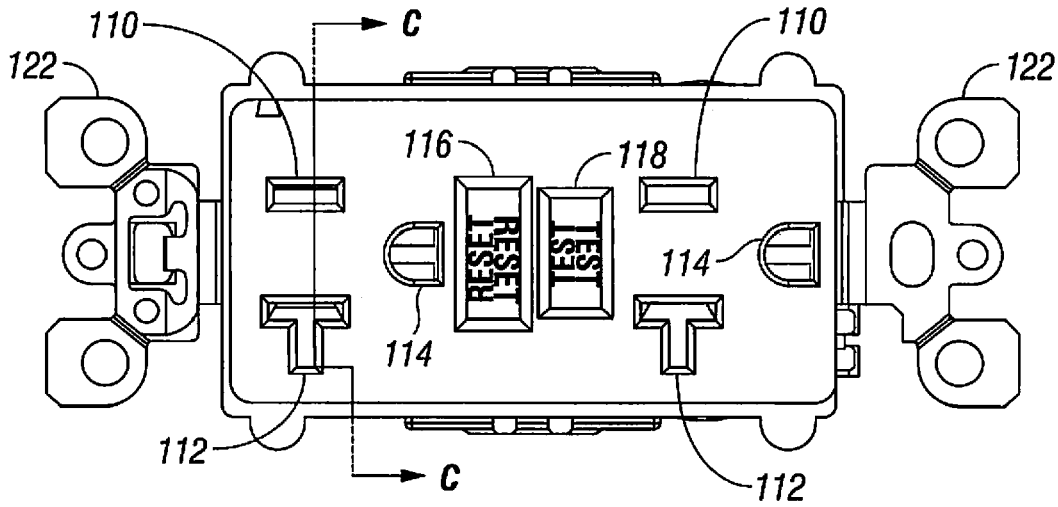
FIG. 18 displays a cross-sectional view of FIG. 17 taken along Section line C-C where the cut extends through receptacle when the pivoting locking rod is in the unlocked position.

FIG. 18 displays a cross-section view of FIG. 17 taken along Section line C-C where the cut extends through receptacle 100 when the pivoting locking bar 128, 130 is in the unlocked position. Specifically, prongs (not shown) are inserted in entry ports 110*a*, 112*a* overcoming the bias of spring 164 causing said spring to be shifted by the sliding shutter 124 which is caused to slide by the insertion of the prongs. As shown, entry port 110*a*, and apertures 150, and 145*a* align to enable a prong inserted in aperture 110*a* to pass through the tamper resistant shutter 124 at aperture 150 and make contact with receptacle terminal 142*a*. In addition, a second prong may simultaneously pass through apertures 112*a* and 146*a* to make contact with receptacle terminal 142*b*.

Figure 19:
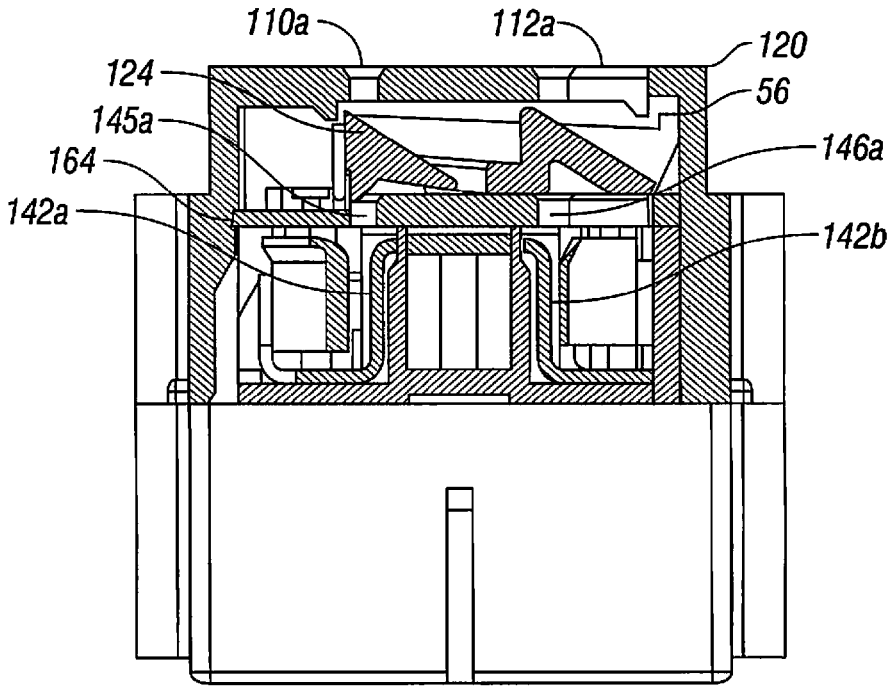
FIG. 19 displays a cross-sectional view of FIG. 17 taken along Section line C-C where the cut extends through the cover without cutting shutter when the pivoting locking rod is in the locked position.

FIG. 17 illustrates the same receptacle 100 of FIG. 11 having cut line C-C. FIG. 19 displays a cross-section view of FIG. 18 taken along Section line C-C where the cut extends through the cover 120 without cutting shutter 124 with the pivoting locking rod sections 128, 130 in the locked position. Specifically, tamper resistant shutter 124 having projections 158, 160, and 162 sits inside cover 120 under entry ports 110*a* and 112*a*. Spring 164 biases tamper resistant shutter 124 into a locked position; shutter 124 is kept from moving out of the locked position by one of the sections (see FIG. 14) of the pivoting locking rod 128, 130.

Figure 19A:
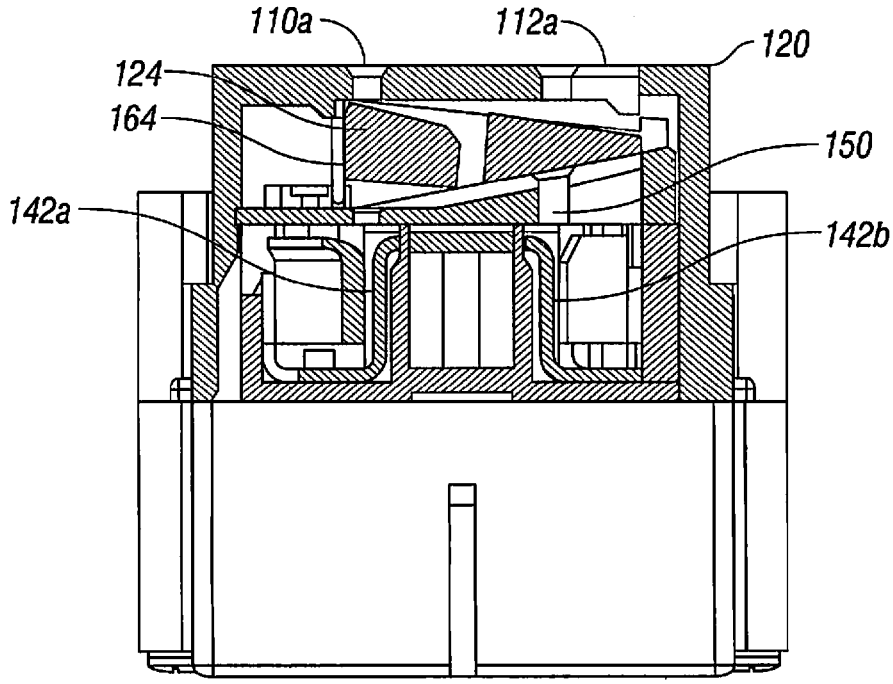
FIG. 19A is a view of the device in FIG. 19 in accordance with another embodiment of the device where an additional ramp element is added to decrease the angle on the shutter such that the shutter is supported on an angled platform as opposed to a flat platform.

FIG. 19A is a view of the device in FIG. 19 in accordance with another exemplary embodiment of the device where an additional ramp element is added to decrease the angle on the shutter 124 such that the shutter 124 is supported on an angled platform as opposed to a flat platform.

Figure 20:
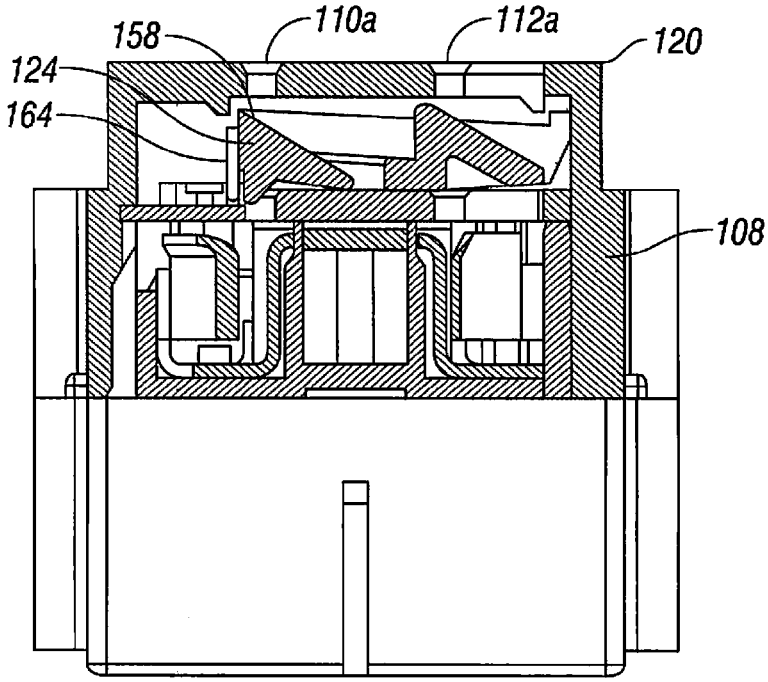
FIG. 20 shows a cross-sectional view of FIG. 17 taken along Section line C-C where the cut extends through the cover without cutting shutter when the pivoting locking rod is in the locked position and wherein an electrical prong (not shown) is inserted causing the shutter to tilt in an intermediate position.

FIG. 20 shows a cross-section view of FIG. 18 taken along Section line C-C where the cut extends through the cover 120 without cutting shutter 124 when the pivoting locking rod 128, 130 is in the locked position and where an electrical prong (not shown) is inserted causing the shutter 124 to tilt in a direction shown by arrow 125. When an object probes aperture 110*a* without probing aperture 112*a*, tamper resistant shutter 124 tilts in the direction shown by arrow 125 down and does not shift out of the locked position since spring 164 holds shutter 124 in the locked position.

Figure 21:
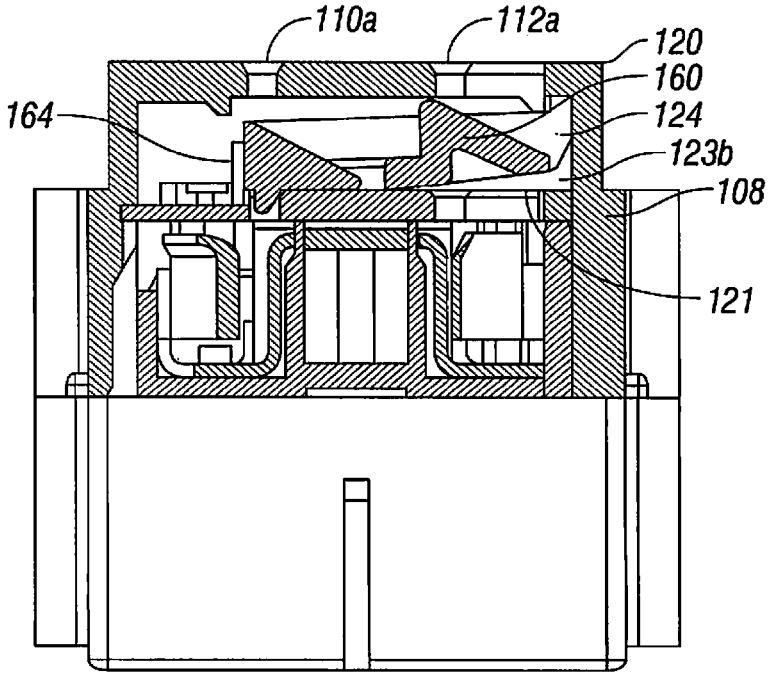
FIG. 21 displays a cross-sectional view of FIG. 17 taken along Section line C-C where the cut extends through the cover without cutting shutter when the pivoting locking rod is in the locked position and wherein an electrical prong (not shown) is inserted causing the shutter to tilt fully.

FIG. 21 displays a cross-section view of FIG. 18 taken along Section line C-C where the cut extends through the cover 120 without cutting shutter 124 when the pivoting locking rod 128, 130 is in the locked position and wherein an electrical prong (not shown) is inserted causing the shutter 124 to tilt fully. More particularly, when the same object is inserted further through entry port 110*a*, the projection 156 on the interior surface of cover 120 catches the projection 162 of shutter 124 such that shutter 124 remains in the locked position. Shutter 124 tilts as described when probed at one point near projection 158 because a part 123*a* of its bottom portion 123 is raised with respect to surface 121 of housing 108. Part 123*b* of bottom portion 123 is also raised with respect to surface 121, but to a different extent than part 123*a*. As a result, shutter 124 is able to tilt when only one of the entry ports (110*a*, 112*a*) is probed. Shutter 126 is configured and operates in substantially the same manner as shutter 124.

Those of skill in the art recognize that the physical location of the elements illustrated in FIGS. 11-15 can be moved or relocated while retaining the function described above. For example, in another exemplary embodiment of a receptacle in accordance with the present disclosure, the mechanical arm is replaced by a solenoid which differs from the existing trip solenoid incorporated in the design of a GFCI (see FIG. 14A). This solenoid is activated by the GFCI circuitry instead of the mechanical movement of the lifter. Other embodiments may incorporate, but are not limited to, a spring, muscle wire, etc. for substitution of the mechanical arm.

Advantages of this design include but are not limited to an electrical receptacle having an circuit interrupter which is tamper resistant and enabled to detect and prevent reverse wiring (e.g., via a shutter lock that is operatively connected in the receptacle to receive power from the power source connected to the receptacle). The electrical receptacle in accordance with the present disclosure includes a high performance, simple, and cost effective design.

Although the present disclosure has been described in accordance with the embodiments shown, one of ordinary skill in the art will readily recognize that there could be variations to the embodiment and these variations would be within the spirit and scope of the present disclosure. Accordingly, many modifications may be made by one of ordinary skill in the art without departing from the spirit and scope of the appended claims.

We claim:

1. A receptacle comprising:

a front surface including one or more slots for receiving contact blades;

a rear surface including one or more terminals for connecting the contact blades to a power source, the one or more terminals being line terminals and load terminals;

a shutter positioned between the front surface and the rear surface of the receptacle, the shutter configured to be misaligned in relation to the one or more slots in order to obstruct a direct path between the contact blades and the one or more terminals, wherein insertion of an object in the one or more slots causes displacement of the shutter; and a shutter lock operatively connected in the receptacle to receive power from the power source connected to the receptacle;

wherein the shutter is disabled by one or more pivoting locking mechanisms, the one or more pivoting locking mechanisms having a bendable locking rod operably attached to a mechanical arm, a movable bridge, and a lifter.

2. The receptacle of claim 1, wherein the shutter is a child resistant shutter.

3. The receptacle of claim 1, wherein the one or more pivoting locking mechanisms prevent operation of the shutter even when the contact blades are correctly inserted into the one or more slots on the front surface of the receptacle if the receptacle is not properly wired to a source of power.

4. The receptacle of claim 1, wherein the one or more pivoting locking mechanisms are moved to an unlocked position when the power from the power source is applied to the line terminals of the receptacle.

5. The receptacle of claim 1, wherein the one or more pivoting locking mechanisms remain in a locked position until the receptacle is correctly wired.

6. The receptacle of claim 1, wherein the shutter is in operable communication with a ground fault circuit interruptor (GFCI).

7. The receptacle of claim 6, wherein the GFCI is in an unlocked state when the receptacle is correctly wired to a source of power at a line side of the GFCI.

8. The receptacle of claim 6, wherein the lifter displaces the movable bridge to force a non-tripped condition and allow insertion of the contact blades when the receptacle is correctly wired.

9. A receptacle comprising:

a front surface and at least one other surface having at least one terminal for connecting a compatible object to a power source;

a shutter positioned between the front surface and a rear surface, the shutter configured to prevent a non-compatible object from being inserted into one or more slots of the front surface of the receptacle; and a shutter lock operatively connected in the receptacle to receive power from the power source connected to the receptacle preventing displacement of said shutter when the receptacle is reverse-wired;

wherein the shutter is disabled by one or more pivoting locking mechanisms, the one or more pivoting locking mechanisms having a bendable locking rod operably attached to a mechanical arm, a movable bridge, and a lifter.

10. The receptacle of claim 9, wherein the one or more pivoting locking mechanisms remain in a locked position until the receptacle is correctly wired.

11. The receptacle of claim 9, wherein the shutter is in operable communication with a ground fault circuit interruptor (GFCI).

12. The receptacle of claim 11, wherein the GFCI is in an unlocked state when the receptacle is correctly wired to a source of power at a line side of the GFCI.

13. A method for preventing misuse of a receptacle with a tamper-resistant device, the receptacle having a front surface including one or more slots for receiving contact blades and a rear surface including one or more terminals for connecting the contact blades to a power source, the one or more terminals being line terminals and load terminals, the tamper-resistant device positioned between the front surface and the rear surface of the receptacle and configured to be misaligned in relation to the one or more slots in order to obstruct a direct path between the contact blades and the one or more terminals, wherein insertion of an object in the one or more slots causes displacement of the tamper-resistant device, the method comprising the steps of:

locking said tamper resistant device in said misaligned position with one or more pivoting locking mechanisms, said pivoting locking mechanism having a locking rod operably attached to a mechanical arm, a movable bridge, and a lifter; and preventing said pivoting locking mechanism from releasing unless said receptacle is safely wired.

14. The method of claim 13, wherein the tamper-resistant device is a child resistant device.

15. The method of claim 13, wherein the one or more pivoting locking mechanisms prevent operation of the tamper-resistant device even when the contact blades are correctly inserted into the one or more slots on the front surface of the receptacle if the receptacle is not properly wired to a source of power.

16. The method of claim 13, wherein the one or more pivoting locking mechanisms remain in a locked position until the receptacle is correctly wired.

17. The method of claim 13, wherein the shutter is in operable communication with a ground fault circuit interruptor (GFCI).

18. The method of claim 17, wherein the lifter displaces the movable bridge to force a non-tripped condition and allow insertion of the contact blades when the receptacle is correctly wired.

19. The method of claim 17, wherein the GFCI is in an unlocked state when the receptacle is correctly wired to a source of power at a line side of the GFCI.

20. A receptacle comprising: a front surface; at least one terminal extending from said receptacle for connecting a compatible object to a power source; a shutter positioned between the front surface and a rear surface, the shutter configured to prevent a non-compatible object from being inserted into one or more slots of the front surface of the receptacle; and a shutter lock operatively connected in the receptacle to receive power from the power source connected to the receptacle preventing displacement of said shutter when the receptacle is reverse-wired; wherein the shutter is disabled by one or more pivoting locking mechanisms, the one or more pivoting locking mechanisms having a bendable locking rod operably attached to a mechanical arm, a movable bridge, and a lifter.

* * * * *